US007447328B2

(12) United States Patent
Takewa et al.

(10) Patent No.: US 7,447,328 B2
(45) Date of Patent: Nov. 4, 2008

(54) LOUDSPEAKER

(75) Inventors: Hiroyuki Takewa, Kaizuka (JP); Mikio Iwasa, Katano (JP); Atsushi Inaba, Matsusaka (JP); Satoshi Koura, Ichishi-gun (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 500 days.

(21) Appl. No.: 10/917,423

(22) Filed: Aug. 13, 2004

(65) Prior Publication Data

US 2005/0041830 A1 Feb. 24, 2005

(30) Foreign Application Priority Data

Aug. 19, 2003 (JP) ..... 2003-295108

(51) Int. Cl.
*H04R 1/00* (2006.01)

(52) U.S. Cl. ..... 381/424; 381/423; 381/396; 381/150

(58) Field of Classification Search ..... 381/424, 381/423, 396, 150, 39, 400, 405, 410
See application file for complete search history.

(56) References Cited

U.S. PATENT DOCUMENTS 2,392,143 A 1/1946 Graham
2,657,758 A * 11/1953 Varnet ..... 181/164
2,775,653 A 12/1956 Wurdel
4,088,847 A * 5/1978 Yukimoto et al. ..... 381/410
4,376,233 A * 3/1983 Kamon et al. ..... 381/409
5,472,736 A * 12/1995 Barr et al. ..... 427/123
5,664,024 A * 9/1997 Furuta et al. ..... 381/412
5,764,784 A 6/1998 Sato et al.
5,862,242 A * 1/1999 Takewa et al. ..... 381/398
6,154,556 A * 11/2000 Takahashi et al. ..... 381/430
6,341,167 B1 * 1/2002 Okuyama et al. ..... 381/407
6,370,257 B1 * 4/2002 Bleim et al. ..... 381/409
6,636,612 B1 * 10/2003 North et al. ..... 381/412
6,654,475 B2 * 11/2003 Nakaso ..... 381/396
6,714,655 B2 * 3/2004 Iwasa et al. ..... 381/396
6,757,404 B2 * 6/2004 Takewa et al. ..... 381/430
6,771,792 B1 * 8/2004 Shirakawa ..... 381/412
6,801,634 B2 * 10/2004 Button ..... 381/398
6,920,957 B2 * 7/2005 Usuki et al. ..... 181/173
6,925,191 B2 * 8/2005 Petroff et al. ..... 381/423
7,095,869 B2 * 8/2006 Button ..... 381/423

(Continued)

FOREIGN PATENT DOCUMENTS

DE 952 649 11/1956

(Continued)

*Primary Examiner*—Lincoln Donovan
*Assistant Examiner*—Forrest Phillips
(74) *Attorney, Agent, or Firm*—Wenderoth, Lind & Ponack, L.L.P.

(57) ABSTRACT

A loudspeaker includes a diaphragm, an edge, and a voice coil. The diaphragm includes a groove having a concave cross section. Also, the diaphragm is in a horizontally or vertically elongated shape. The edge is coupled to an outer circumference of the diaphragm, and has a roughly half-round shaped cross section. The voice coil is bonded to the groove. The voice coil is thicker than a depth of the groove. Also, the voice coil has a cross section in which a dimension in a direction along a plane of the diaphragm is longer than a dimension in a direction perpendicular to the plane of the diaphragm.

10 Claims, 19 Drawing Sheets

U.S. PATENT DOCUMENTS

| | | | | |
|---|---|---|---|---|
| 2001/0017922 | A1* | 8/2001 | Kim | 381/150 |
| 2001/0017928 | A1* | 8/2001 | Sugiyama et al. | 381/396 |
| 2002/0039430 | A1* | 4/2002 | Nakaso | 381/396 |
| 2002/0067842 | A1* | 6/2002 | Takahashi et al. | 381/379 |
| 2003/0081808 | A1* | 5/2003 | Kemmerer | 381/397 |
| 2003/0216080 | A1* | 11/2003 | Schmitt et al. | 439/371 |
| 2004/0038500 | A1* | 2/2004 | Larson et al. | 438/484 |
| 2004/0081331 | A1* | 4/2004 | Ando et al. | 381/398 |
| 2004/0218779 | A1* | 11/2004 | Fukuyama et al. | 381/409 |
| 2004/0264731 | A1* | 12/2004 | Nakamura et al. | 381/423 |
| 2005/0041830 | A1* | 2/2005 | Takewa et al. | 381/410 |
| 2005/0152577 | A1* | 7/2005 | Nishimura et al. | 381/431 |
| 2005/0175205 | A1* | 8/2005 | Takahashi | 381/336 |
| 2005/0226456 | A1* | 10/2005 | Tabata et al. | 381/398 |
| 2005/0271236 | A1* | 12/2005 | Kobayashi et al. | 381/396 |
| 2005/0286729 | A1* | 12/2005 | Harwood et al. | 381/152 |
| 2006/0002578 | A1* | 1/2006 | Kim et al. | 381/396 |
| 2006/0034479 | A1* | 2/2006 | Oshika et al. | 381/386 |
| 2006/0062422 | A1* | 3/2006 | Ono et al. | 381/424 |
| 2006/0072248 | A1* | 4/2006 | Watanabe et al. | 360/318 |
| 2006/0078154 | A1* | 4/2006 | Yang | 381/423 |
| 2006/0088184 | A1* | 4/2006 | Ohashi et al. | 381/430 |
| 2006/0110001 | A1* | 5/2006 | Saint Vincent et al. | 381/396 |
| 2006/0153420 | A1* | 7/2006 | Takase et al. | 381/424 |
| 2007/0009133 | A1* | 1/2007 | Gerkinsmeyer | 381/398 |

FOREIGN PATENT DOCUMENTS

| | | | |
|---|---|---|---|
| DE | 1 174 364 | | 7/1964 |
| DE | 1 930 590 | | 12/1970 |
| EP | 1 003 350 | | 5/2000 |
| EP | 1 128 705 | | 8/2001 |
| EP | 1 194 003 | A2 | 4/2002 |
| GB | 2 114 855 | | 8/1983 |
| JP | 58119298 | * | 1/1982 |
| JP | 57-039697 | | 3/1982 |
| JP | 59-032294 | | 2/1984 |
| JP | 5-38639 | | 5/1993 |
| JP | 407288894 | * | 10/1995 |
| JP | 08-140185 | | 5/1996 |
| JP | 10-191494 | | 7/1998 |
| JP | 2003-320919 | | 11/2002 |

* cited by examiner

LOUDSPEAKER

BACKGROUND OF THE INVENTION

1. Field of the Invention

The present invention relates to a loudspeaker, and more particularly to a loudspeaker for use in a variety of types of audio apparatuses, for example, an audio and visual apparatus.

2. Description of the Background Art

Conventionally, an audio and visual apparatus, such as a television, is configured so as to include loudspeakers on opposite sides of a cathode-ray tube. Accordingly, as the loudspeakers for use in the audio and visual apparatus, loudspeakers structured in an elongated shape, such as a rectangle, an ellipse, etc., are used. In recent years, as a display screen becomes wider, the loudspeakers for use in the audio and visual apparatus are required to become narrower, and also required to become thinner so as to be adapted to an apparatus with a thin depth, such as a liquid crystal display or a plasma display.

Here, a conventional loudspeaker with an elongated structure is described with reference to FIGS. 17 through 19. FIG. 17 is a plan view of the conventional loudspeaker with an elongated structure, FIG. 18 is a cross-sectional view of the loudspeaker in a long axis direction, and FIG. 19 is a cross-sectional view of the loudspeaker in a short axis direction. In FIGS. 17 through 19, a diaphragm 1, which creates air vibration, has an elongated shape, and an outer circumference of the diaphragm 1 is supported to a frame 3 via an edge 2. A voice coil 4 is fixed on a planar portion of the diaphragm 1.

The frame 3 includes in its center a magnetic circuit 8 consisting of a yoke 5, a magnet 6, and a top plate 7. In FIG. 19, the magnet 6 is magnetized in a direction perpendicular to the diaphragm 1 (i.e., a direction of arrow Z shown in FIG. 19). Accordingly, a magnetic gap 9, where magnetic flux is generated in a direction perpendicular to the diaphragm 1, is formed between an opening of the yoke 5 (in the vicinity of the edge 2) and the top plate 7. The voice coil 4 is located within the magnetic gap 9 in a direction perpendicular to the magnetic flux (i.e., a direction perpendicular to the sheet of FIG. 19). Accordingly, if an alternating current is applied to the voice coil 4, the diaphragm 1 is caused to vibrate in the direction of arrow Z shown in FIG. 19, thereby emitting sound waves into space.

In a conventional loudspeaker, a voice coil is bonded to a planar portion of a diaphragm by an adhesive. Each wire of the voice coil has a circular cross section, and therefore an area of contact between the voice coil and the diaphragm is small. Also, the adhesive is easily spread into a thin sheet over the diaphragm, and therefore an adhesive layer made of the adhesive becomes thin. Due to the small contact area and the thin adhesive layer, adhesive strength between the voice coil and the diaphragm is small. Accordingly, the diaphragm and the voice coil are separated from each other, resulting in an increase in distortion of the diaphragm during vibration or causing insufficient vibration.

Note that, particularly in the loudspeaker with an elongated structure, the diaphragm is easily distorted during vibration, and therefore it is required to increase the adhesive strength between the diaphragm and the voice coil. Also, in a voice coil having a horizontally-elongated cross section (i.e., if a vibration direction of the diaphragm corresponds to a vertical direction, the cross section of the voice coil is short in the vertical direction and long in the horizontal direction), if the adhesive strength between the voice coil and the diaphragm is small, wires of the voice coil might be separated from each other due to the vibration of the diaphragm. If the wires of the voice coil are separated from each other, reproduction sound quality is reduced.

SUMMARY OF THE INVENTION

Therefore, an object of the present invention is to provide a loudspeaker with an elongated structure which is capable of increasing adhesive strength between a diaphragm and a coil.

The present invention has the following features to attain the object mentioned above. A first aspect of the present invention is directed to a loudspeaker including a diaphragm, an edge, and a voice coil. The diaphragm includes a groove having a concave cross section. Also, the diaphragm is in a horizontally or vertically elongated shape. The edge has a roughly half-round shaped cross section and is coupled to an outer circumference of the diaphragm. The voice coil is bonded to the groove. Here, the voice coil is thicker than a depth of the groove. Also, the voice coil has a cross section in which a dimension in a direction along a plane of the diaphragm is longer than a dimension in a direction perpendicular to the plane of the diaphragm.

Note that an adhesive for bonding the voice coil to the diaphragm may be applied so as to form an adhesive fillet covering side surfaces of the voice coil.

Also, a plurality of protrusions, which each are smaller than a diameter of a wire of the voice coil, may be provided on a bonding surface of the groove that is bonded to the voice coil.

A second aspect of the present invention is directed to a loudspeaker including a diaphragm, an edge, a voice coil, and a film. The diaphragm includes a groove having a concave cross section. Also, the diaphragm is in a horizontally or vertically elongated shape. The edge has a roughly half-round shaped cross section and is coupled to an outer circumference of the diaphragm. The voice coil is bonded to the groove. The film is fixed on the diaphragm and the voice coil so as to cover the voice coil on a side opposite to a bonding surface of the diaphragm that is bonded to the voice coil.

Note that the film is formed by, for example, any one of a polymer film, a polymer film having metal foil evaporated thereon, and the metal foil.

Also, the film may be made of a viscoelastic material.

A third aspect of the present invention is directed to a loudspeaker including a diaphragm, an edge, a cushioning material, and a voice coil. The diaphragm includes a groove having a concave cross section. Also, the diaphragm is in a horizontally or vertically elongated shape. The edge has a roughly half-round shaped cross section and is coupled to an outer circumference of the diaphragm. The cushioning material is bonded to the groove, and has a planar shape. The voice coil is bonded to the groove via the cushioning material.

Note that a cross section of the diaphragm along a longitudinal direction may have a shape of an arc which is lower than the edge.

In the first aspect, the adhesive for bonding the voice coil to the diaphragm is retained in the groove, so that the voice coil and the diaphragm can be bonded together with the adhesive of a sufficient thickness. Accordingly, as compared to a conventional structure, it is possible to increase adhesive strength between the voice coil and the diaphragm, thereby increasing reproduction sound quality of the loudspeaker. Also, in the first aspect, since the voice coil is bonded to the diaphragm so as to form a horizontally elongated shape, it is possible to reduce the thickness of the loudspeaker, while increasing the reproduction sound quality. Further, in the first aspect, it is possible to apply sufficient pressure to the diaphragm and the voice coil when bonding them together. Accordingly, it is possible to more tightly bond the diaphragm and the voice coil together. Furthermore, in the first aspect, the groove increases the rigidity of the diaphragm, and therefore it is possible to increase a high range resonance frequency of the diaphragm, whereby it is possible to provide a loudspeaker with a high reproduction characteristic.

Also, if the adhesive for bonding the voice coil to the diaphragm is applied so as to form an adhesive fillet covering side surfaces of the voice coil, it is possible to further increase the adhesive strength between the voice coil and the diaphragm.

Also, if protrusions are provided on the groove, a contact area between the adhesive and the diaphragm is increased, thereby further increasing the adhesive strength between the diaphragm and the voice coil.

Further, in the second aspect, as in the first aspect, since the diaphragm is configured so as to include a groove, it is possible to increase the adhesive strength between the voice coil and the diaphragm, thereby increasing reproduction sound quality of the loudspeaker. Further, by sandwiching the voice coil between the diaphragm and a film, it is possible to increase the adhesive strength between the voice coil and the diaphragm.

Also, if the film is metal foil or a polymer film having the metal foil evaporated thereon, an heat conduction effect of the film reduces an increase in temperature of the voice coil. Accordingly, it is possible to realize a loudspeaker operable with greater input power.

Also, if the film is made of a viscoelastic material, internal loss of the film prevents unnecessary resonance of the voice coil. Accordingly, it is possible to further reduce distortion of the diaphragm during vibration.

Further, in the third aspect, as in the first aspect, since the diaphragm is configured so as to include a groove, it is possible to increase the adhesive strength between the voice coil and the diaphragm, thereby increasing reproduction sound quality of the loudspeaker. Further, a cushioning material is provided between the diaphragm and the voice coil, so that internal loss of the cushioning material prevents unnecessary resonance of the voice coil, thereby increasing sound quality of the loudspeaker.

Also, if the diaphragm is formed so as to have an arc-shaped cross section, it is possible to increase the rigidity of the diaphragm as compared to a case where the diaphragms has a cross section formed by straight lines. Accordingly, it is possible to increase a high range resonance frequency of the diaphragm. Therefore, it is possible to provide a loudspeaker with a high reproduction characteristic.

These and other objects, features, aspects and advantages of the present invention will become more apparent from the following detailed description of the present invention when taken in conjunction with the accompanying drawings.

DESCRIPTION OF THE PREFERRED EMBODIMENTS

First Embodiment

Figure 1:
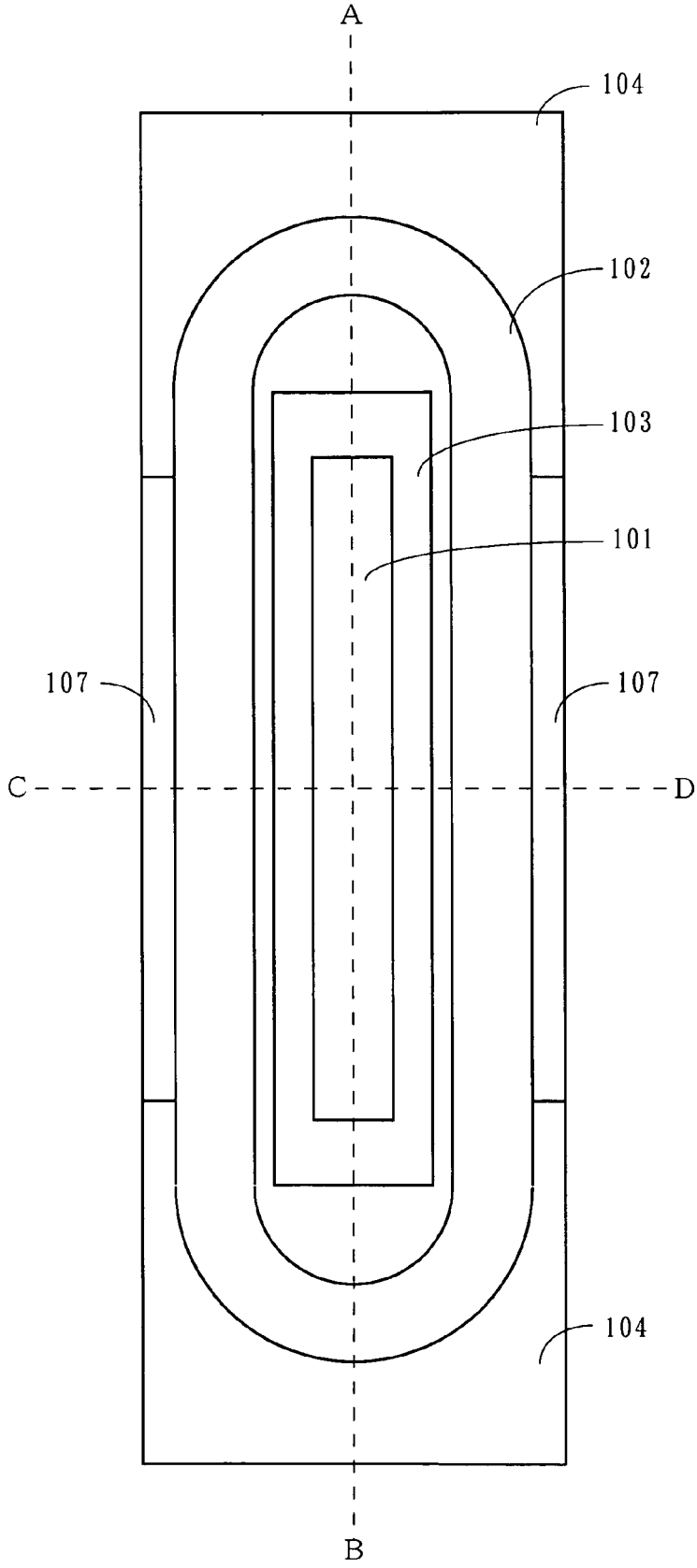
FIG. 1 is a plan view of a loudspeaker according to a first embodiment.
Figure 2:
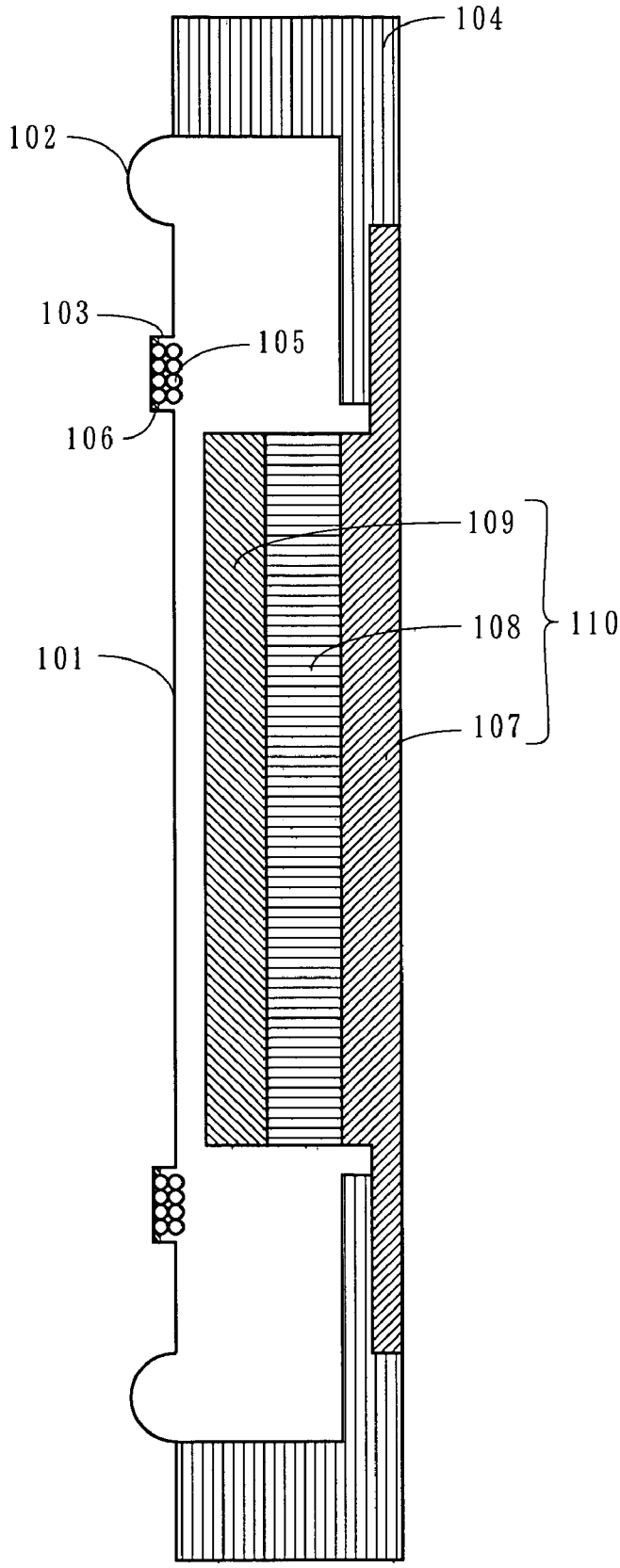
FIG. 2 is a cross-sectional view of the loudspeaker according to the first embodiment in a long axis direction.
Figure 3:
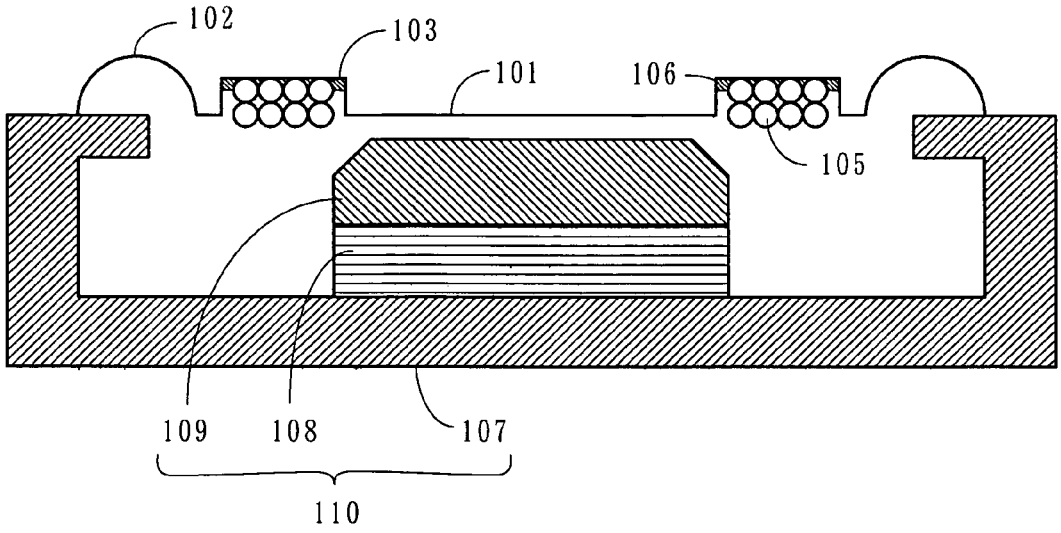
FIG. 3 is a cross-sectional view of the loudspeaker according to the first embodiment in a short axis direction.

A loudspeaker according to a first embodiment of the present invention is now described. FIG. 1 is a plan view of the loudspeaker, FIG. 2 is a cross-sectional view (an A-B cross-sectional view) of the loudspeaker in a long axis direction, and FIG. 3 is a cross-sectional view (a C-D cross-sectional view) of the loudspeaker in a short axis direction. In FIGS. 1 through 3, the loudspeaker includes a diaphragm 101, an edge 102, a frame 104, a voice coil 105, a yoke 107, a magnet 108, and a top plate 109. As shown in FIG. 1, the loudspeaker has a shape which is elongated in a vertical (or horizontal) direction. Note that in the following descriptions, a side of the loudspeaker on which the diaphragm 101 is provided (the left side in FIG. 2) is referred to as an "upper surface side", and a side on which the yoke 107 is provided (the right side in FIG. 2) is referred to as a "lower surface side". Also, a longitudinal direction of the diaphragm 101, which is roughly planar-shaped, is referred to as a "long axis direction", and a direction perpendicular to the long axis direction is referred to as a "short axis direction".

As shown in FIGS. 1 through 3, the diaphragm 101 is planar-shaped except in a portion where a groove 103, which will be described later, is provided. The diaphragm 101 has a shape which is elongated in a vertical (or horizontal) direction. Specifically, the diaphragm 101 has a shape with two opposing parallel sides connected by arcs. The diaphragm 101 is obtained by shaping a thin rigid film such as a polyimide material, or made of a paper material which is light and highly stiff. The edge 102 is provided in the form of a loop around an outer circumference of the diaphragm 101. The edge 102 has a roughly half-round shaped cross section. An outer circumference of the edge 102 is coupled to the frame 104 and the yoke 107. In the first embodiment, two end portions of the edge 102 in the long axis direction (a top-to-bottom direction of the sheet of FIG. 1) are coupled to the frame 104, and a central portion of the edge 102 in the long axis direction is coupled to the yoke 107. As such, the diaphragm 101 is supported to the frame 104 and the yoke 107 via the edge 102.

Also, as shown in FIGS. 2 and 3, a central portion of the frame 104 in the long axis direction is coupled to the yoke 107. The magnet 108 is coupled to the upper surface side of yoke 107. Moreover, the magnet 108 is coupled to the upper surface side of the top plate 109. The yoke 107, the magnet 108, and the top plate 109 form a magnetic circuit 110. The voice coil 105 is bonded to the diaphragm 101 so as to be located in a magnetic gap formed by the magnetic circuit 110. The voice coil 105 is structured by a plurality of turns of electric wires made of copper or aluminum silver covered with an insulating coating. In the structure as shown in FIGS. 1 through 3, if an alternating current is applied to the voice coil 105, a drive force is generated in the voice coil 105 to cause the diaphragm 101 bonded to the voice coil 105 to vibrate, thereby emitting sound.

Here, in the first embodiment, the diaphragm 101 has the groove 103 with a concave cross section (see FIGS. 2 and 3). The voice coil 105 is bonded by an adhesive 106 to the bottom of the concave portion of the groove 103. The groove 103 is formed in a looped shape adapted to the shape of the voice coil 105. Specifically, in the first embodiment, the shape of the voice coil 105 viewed from the upper surface side is a rectangle elongated in the long axis direction, and therefore the groove 103 is formed in a rectangular shape (see FIG. 1). Note that in the first embodiment, although the groove 103 is formed so as to be convex to the upper surface side so that the voice coil 105 is bonded to the diaphragm 101 on the lower surface side, the groove 103 may be formed so as to be convex to the lower surface side, such that the voice coil 105 is bonded to the diaphragm 101 on the upper surface side.

As described above, the voice coil 105 is bonded by the adhesive 106 to a portion of the diaphragm 101 where the groove 103 is provided. Since the groove 103 is formed so as to have a concave cross section, the adhesive 106 does not spread along the plane of the diaphragm 101, so that the adhesive 106 is retained on the bottom of the groove 103. Accordingly, the voice coil 105 and the diaphragm 101 can be bonded together with the adhesive 106 of a sufficient thickness, thereby increasing adhesive strength between the voice coil 105 and the diaphragm 101. Therefore, in the first embodiment, it is possible to prevent the voice coil 105 from being peeled off from the diaphragm 101 due to vibration of the diaphragm 101, thereby preventing a chattering sound from being made, while preventing distortion of the diaphragm from being increased during vibration. Thus, it is possible to increase reproduction sound quality.

Also, in the first embodiment, the voice coil 105 is bonded to the diaphragm 101 so as to form a horizontally elongated shape. Specifically, the voice coil 105 is bonded to the diaphragm 101 such that in the cross section of the voice coil 105, a dimension in a direction along the planar portion of the diaphragm 101 is longer than a dimension in a direction perpendicular to the diaphragm 101 (see FIGS. 2 and 3). This is intended to reduce the thickness of the loudspeaker, and to increase contact between the voice coil 105 and the diaphragm 101, thereby causing the diaphragm 101 to vibrate with ideal piston motion. In the case where the voice coil 105 has the horizontally-elongated shape, there is a possibility that electric wires of the voice coil 105 might be easily separated from each other due to vibration of the diaphragm 101, resulting in reduction of reproduction sound quality. However, in the first embodiment, the adhesive strength between the diaphragm 101 and the voice coil 105 can be increased, and therefore there is substantially no possibility that the electric wires of the voice coil 105 are separated from each other. Thus, in the loudspeaker according to the first embodiment, it is possible to prevent the reproduction sound quality from being reduced.

Also, in the first embodiment, the voice coil 105 is structured so as to be thicker than the depth of the groove 103 (see FIGS. 2 and 3). In other words, the groove 103 is formed so as to be shallower than the thickness of the voice coil 105. This allows pressure to be applied to the diaphragm 101 and the voice coil 105 when bonding them together. Specifically, the diaphragm 101 and the voice coil 105 are caused to be in close contact with each other so as not to form a gap between them, whereby it is possible to more tightly bond them together.

As described above, in the first embodiment, the diaphragm 101 includes the groove 103 such that the voice coil 105 can be bonded at the location of the groove 103. Accordingly, it is possible to increase the adhesive strength between the diaphragm 101 and the voice coil 105, making it possible to increase reproduction sound quality.

Further, in the first embodiment, since the diaphragm 101 includes the groove 103, flexural rigidity of the diaphragm 101 can be increased, whereby it is possible to increase a resonance frequency (a high range resonance frequency) inherent to the diaphragm 101 which is generated in a high frequency range. Accordingly, it is possible to allow the diaphragm 101 to produce piston action with a higher frequency.

Figure 4A:
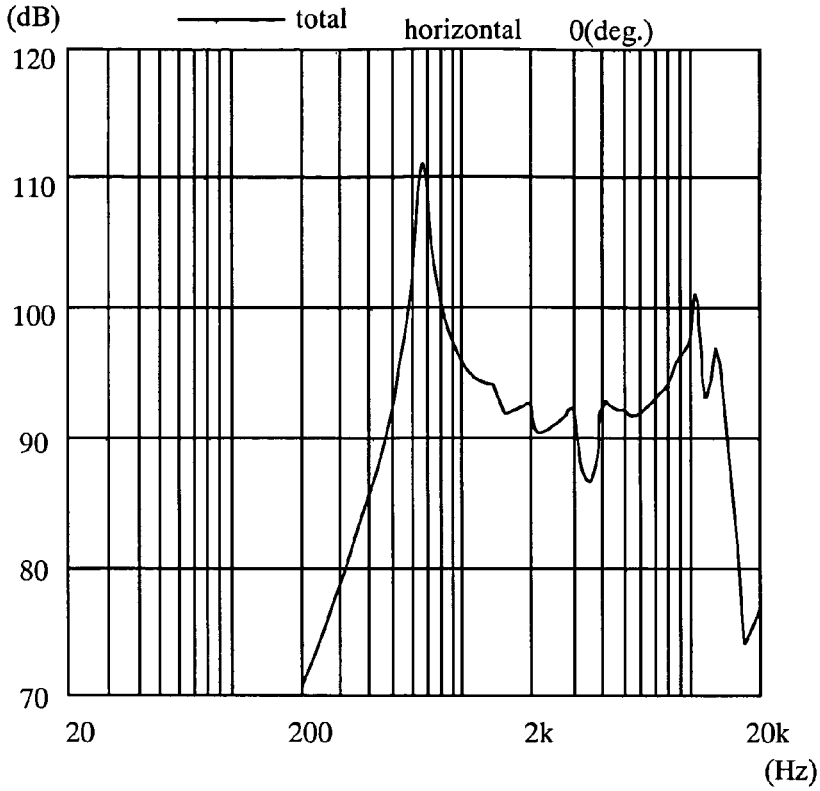
FIG. 4A is a graph showing a sound pressure frequency characteristic of a conventional loudspeaker.
Figure 4B:
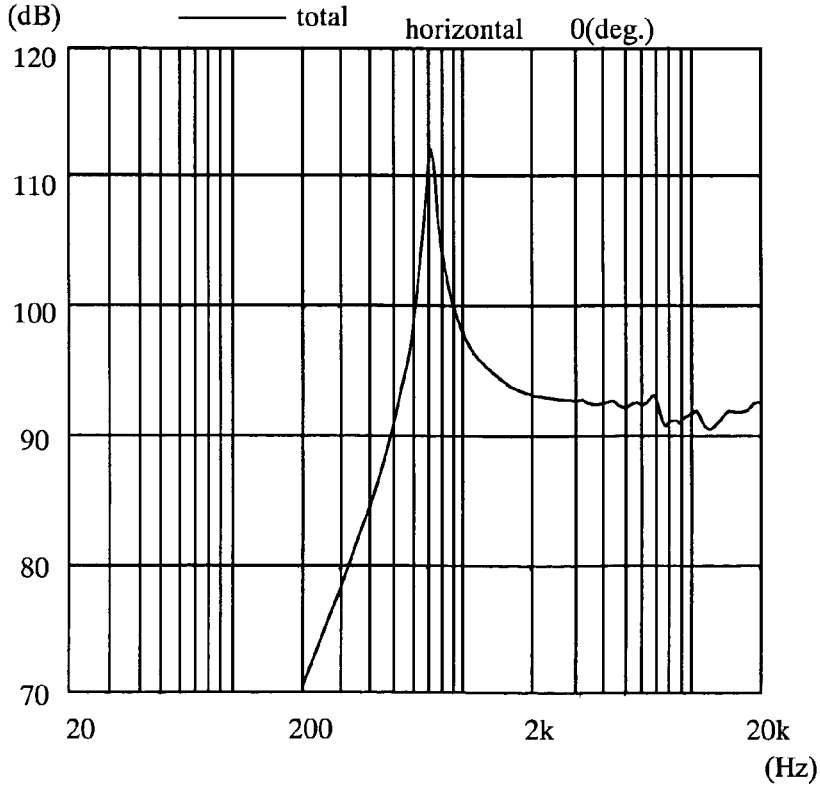
FIG. 4B is a graph showing a sound pressure frequency characteristic of the loudspeaker according to the first embodiment.
Figure 17:
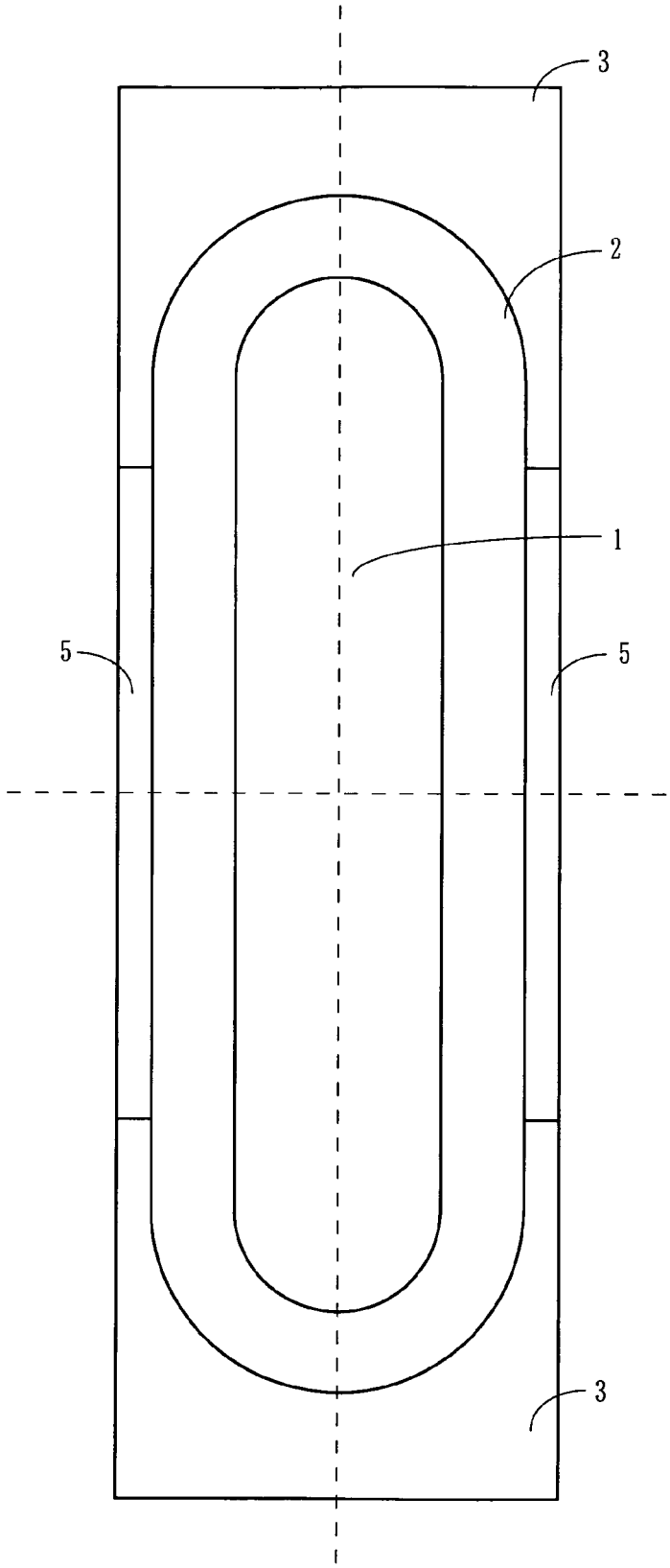
FIG. 17 PRIOR ART
FIG. 17 is a plan view of a conventional loudspeaker with an elongated structure.
Figure 18:
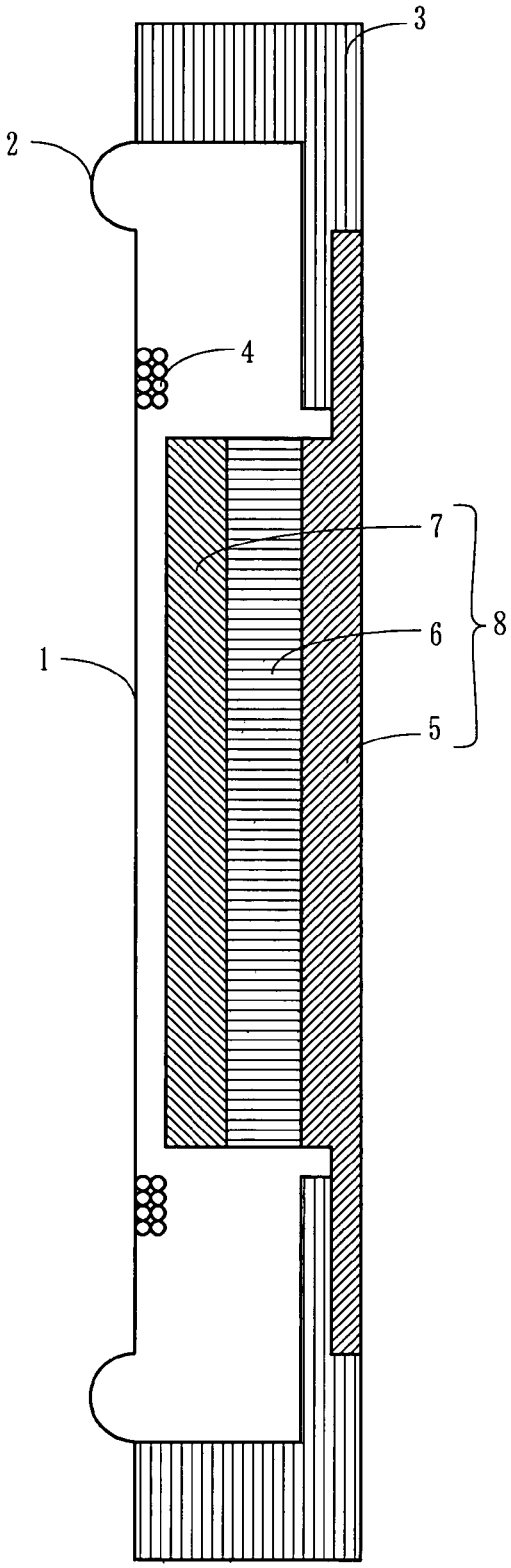
FIG. 18 PRIOR ART
FIG. 18 is a cross-sectional view of the conventional loudspeaker with an elongated structure in the long axis direction.
Figure 19:
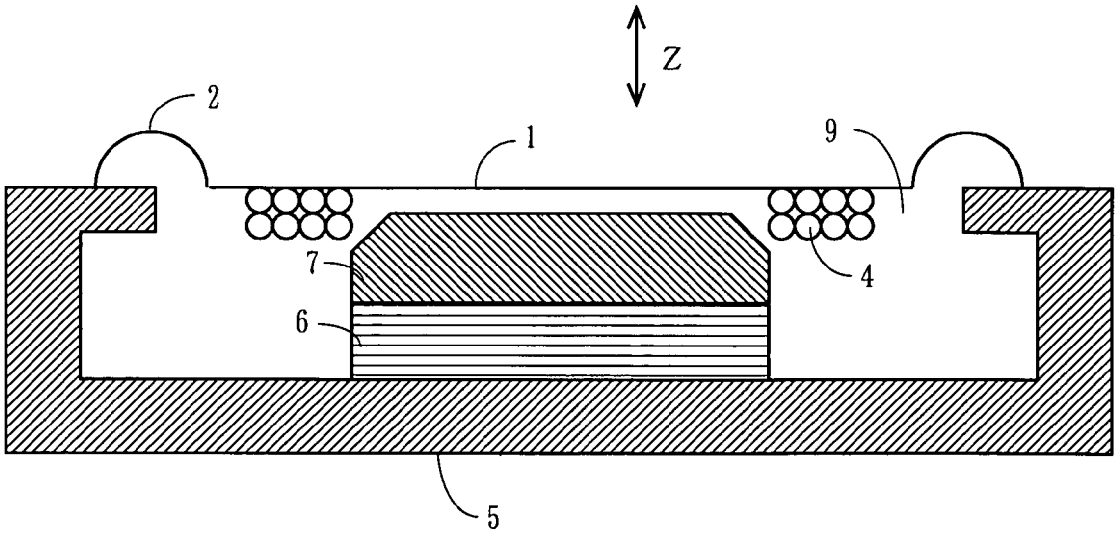
FIG. 19 PRIOR ART
FIG. 19 is a cross-sectional view of the conventional loudspeaker with an elongated structure in the short axis direction.

FIGS. 4A and 4B are graphs respectively showing a sound pressure frequency characteristic of a conventional loudspeaker and a sound pressure frequency characteristic of the loudspeaker according to the first embodiment. Specifically, FIG. 4A is a graph showing a result of using a finite-element method (FEM) to analytically calculate a sound pressure frequency characteristic of a loudspeaker employing a conventional planar diaphragm as shown in FIG. 17. Note that in FIGS. 4A and 4B, the horizontal axis indicates frequencies, and the vertical axis indicates sound pressure levels. In FIG. 4A, high range resonance occurs at a frequency of 10 kHz, and the sound pressure level decreases at higher frequencies, so that sound is not reproduced at a satisfactory level. FIG. 4B is a graph showing a result of using the FEM to analytically calculate a sound pressure frequency characteristic of the loudspeaker according to the first embodiment. In FIG. 4B, resonance does not occur in a high frequency range, so that sound can be reproduced with a higher frequency compared to FIG. 4A.

As is apparent from FIGS. 4A and 4B, in the first embodiment, since the diaphragm 101 includes the groove 103, the rigidity of the diaphragm 101 can be increased, thereby increasing a high range resonance frequency. Particularly, in the diaphragm 101 with an elongated shape as shown in FIG. 1, resonance readily occurs in the long axis direction. However, since the diaphragm 101 includes the groove 103, it is possible to reduce the resonance. Accordingly, in the first embodiment, satisfactory reproduction sound quality can be achieved even in a loudspeaker with an elongated structure. Specifically, the present applicant produced a loudspeaker with an elongated structure using an elongated diaphragm of 50.8 mm in length and 7.0 mm in width (the loudspeaker is 63 mm in length and 11 mm in width). It was confirmed that satisfactory reproduction sound quality can be achieved in the loudspeaker.

Furthermore, in the first embodiment, since the diaphragm 101 includes the groove 103, it is possible to readily and accurately determine a location where the voice coil 105 is bonded to the diaphragm 101. Here, it is preferred that the voice coil 105 is situated in a location where the density of magnetic flux generated by the magnetic circuit 110 is high, and it is necessary for the voice coil 105 to be accurately attached in such a location. In the first embodiment, the groove 103 plays a role of defining the location where the voice coil 105 is attached, and therefore the voice coil 105 can be accurately placed in a suitable location on the diaphragm 101. Moreover, it is possible to reduce variation in location where the voice coil 105 is attached among individual loudspeakers, whereby it is possible to reduce variation in reproduction sound pressure level among the individual loudspeakers.

Note that in FIGS. 2 and 3, although the voice coil 105 is shown as being formed in two layers in a height direction (the vibration direction of the diaphragm 101), the voice coil 105 may be formed in one or more layers.

Second Embodiment

Figure 5:
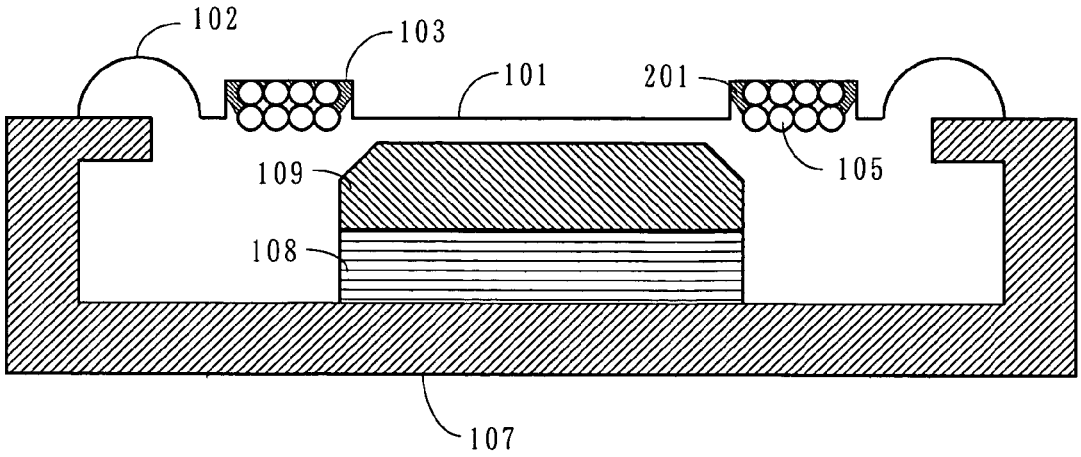
FIG. 5 is a cross-sectional view of a loudspeaker according to a second embodiment in the short axis direction.

Described next is a loudspeaker according to a second embodiment. FIG. 5 is a cross-sectional view of the loudspeaker according to the second embodiment in the short axis direction. Note that the loudspeaker according to the second embodiment has an external appearance similar to that of the loudspeaker according to the first embodiment. A plan view of the loudspeaker is omitted since it is similar to FIG. 1. FIG. 5 corresponds to FIG. 3 in the first embodiment. Note that in FIG. 5, elements similar to those shown in FIGS. 1 through 3 are denoted by the same reference numerals. Hereinbelow, the loudspeaker according to the second embodiment is described mainly with respect to differences from the loudspeaker according to the first embodiment.

In the second embodiment, as in the first embodiment, the voice coil 105 is bonded to the bottom of the groove 103 of the diaphragm 101. Here, in the second embodiment, an adhesive 201 is applied so as to form an adhesive fillet covering side surfaces of the voice coil 105. Specifically, the adhesive 201 is applied so as to cover the side surfaces as well as the bottom of the voice coil 105 (a contact surface with the diaphragm 101). In the second embodiment, it is possible to increase the adhesive strength between the diaphragm 101 and the voice coil 105. Note that in third through seventh embodiments which will be later, the adhesive fillet may be formed.

Third Embodiment

Figure 6:
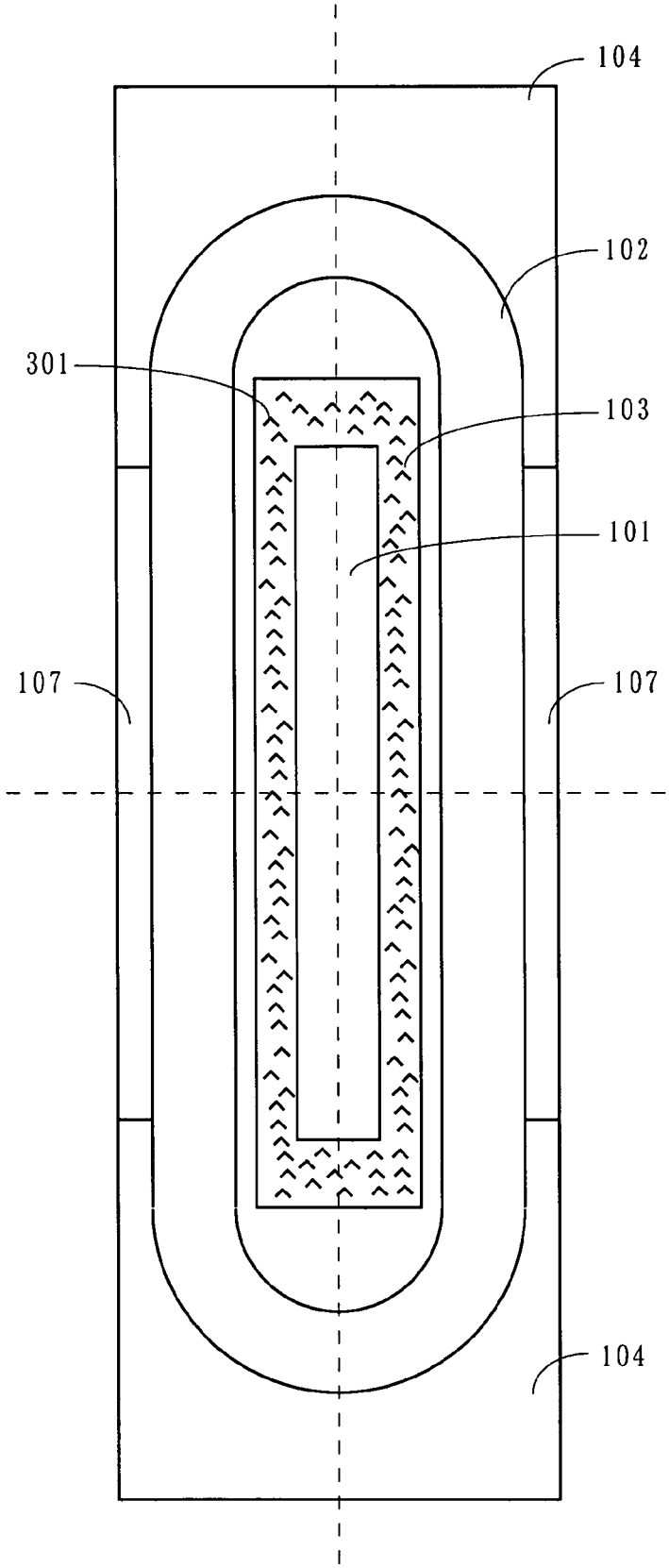
FIG. 6 is a plan view of a loudspeaker according to a third embodiment.
Figure 7:
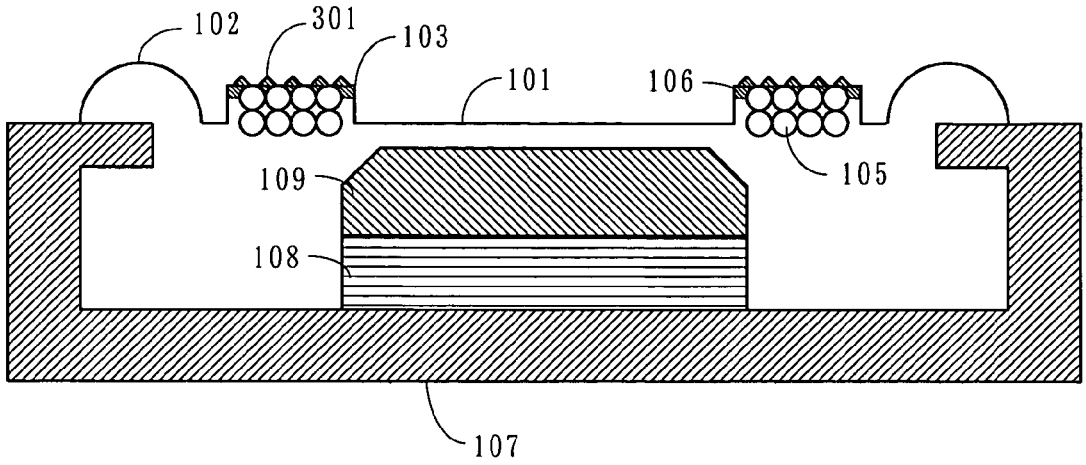
FIG. 7 is a cross-sectional view of the loudspeaker according to the third embodiment in the short axis direction.

Described next is a loudspeaker according to a third embodiment. FIGS. 6 and 7 are views showing a loudspeaker of a third embodiment. Specifically, FIG. 6 is a plan view of the loudspeaker, and FIG. 7 is a cross-sectional view of the loudspeaker in the short axis direction. Note that in FIGS. 6 and 7, elements similar to those shown in FIGS. 1 through 3 are denoted by the same reference numerals. Hereinbelow, the loudspeaker according to the third embodiment is described mainly with respect to differences from the loudspeaker according to the first embodiment.

In the third embodiment, a plurality of protrusions 301 are provided on the bottom of the groove 103 of the diaphragm 101. It is preferred that the protrusions 301 each are smaller (in height or width) than a diameter of a wire of the voice coil 105. The protrusions 301 may be regularly or irregularly placed on the bottom of the groove 103. Also, the protrusions 301 may be convex to the upper or lower surface side of the diaphragm 101. In the third embodiment, a contact area between the adhesive 106 and the diaphragm 101 is increased by the protrusions 301, thereby further increasing the adhesive strength between the diaphragm 101 and the voice coil 105.

Figure 8:
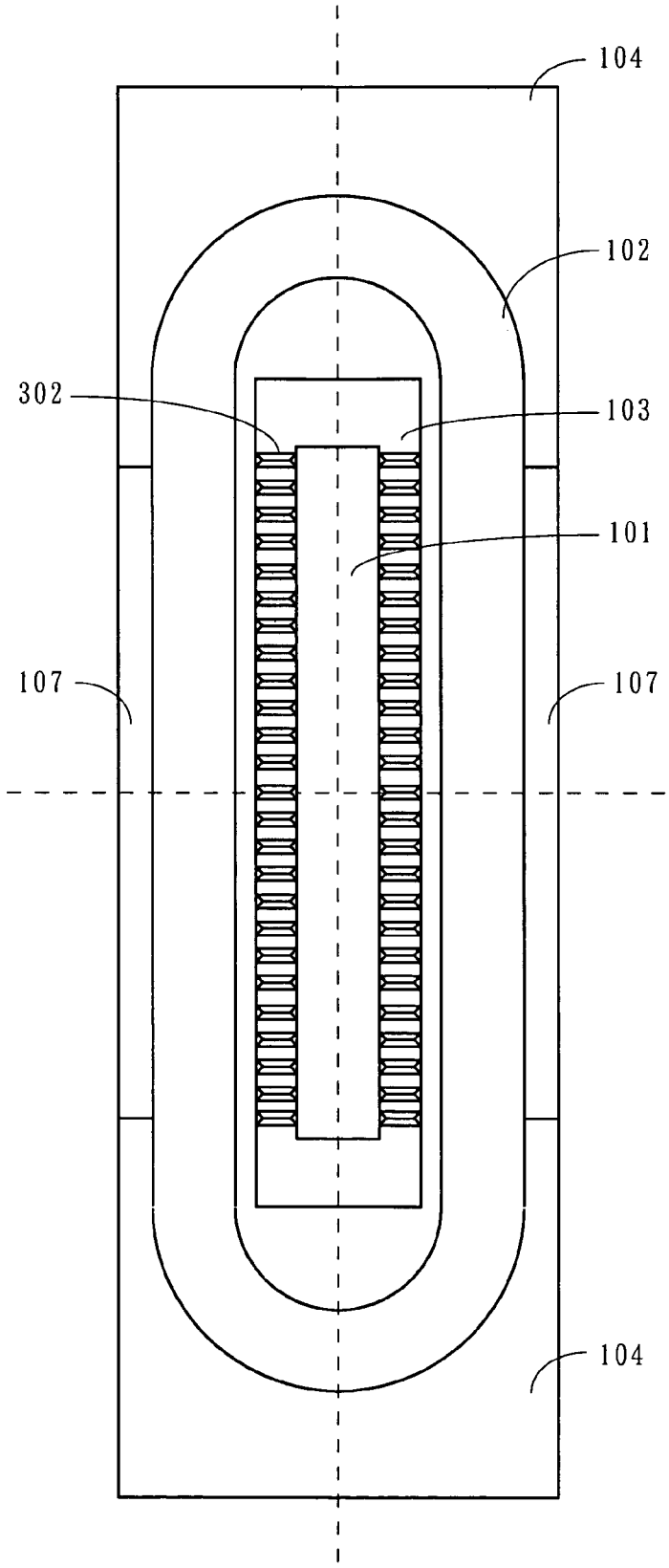
FIG. 8 is a plan view of a variation of the loudspeaker according to the third embodiment.

Note that in the third embodiment, instead of providing the protrusions 301, ribs 302 may be provided on the bottom of the groove 103. FIG. 8 is a plan view of a variation of the loudspeaker according to the third embodiment. In FIG. 8, ribs 302 are provided in a direction perpendicular to a winding direction of the voice coil 105. By providing the ribs 302 to the diaphragm 101, it is possible to achieve an effect similar to that achieved by providing the protrusions 301 to the diaphragm 101.

Note that in fourth through seventh embodiments which will be described, the protrusions 301 or the ribs 302 may be provided to the diaphragm 101.

Fourth Embodiment

Figure 9:
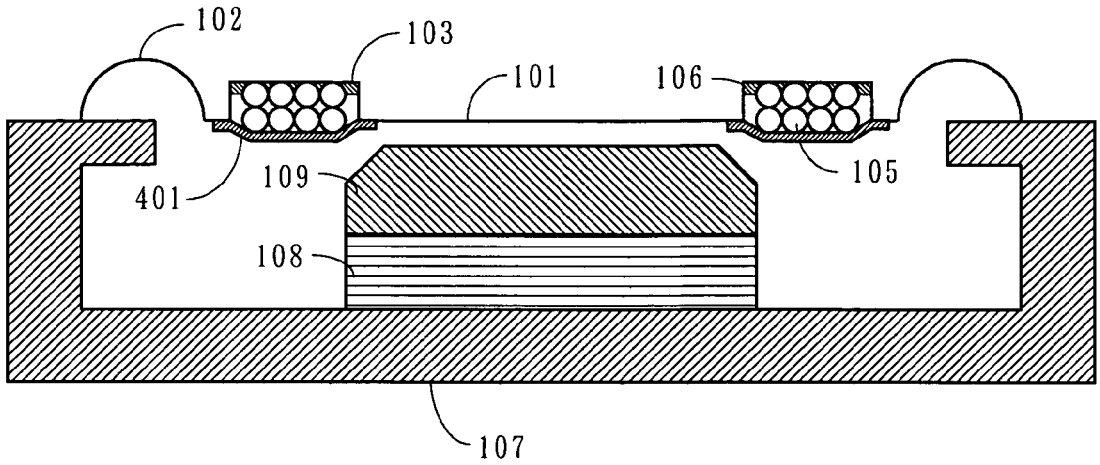
FIG. 9 is a cross-sectional view of a loudspeaker according to a fourth embodiment in the short axis direction.

Described next is a loudspeaker according to a fourth embodiment. FIG. 9 is a cross-sectional view of the loudspeaker according to the fourth embodiment in the short axis direction. Note that the loudspeaker according to the fourth embodiment has an external appearance similar to that of the loudspeaker according to the first embodiment. A plan view of the loudspeaker is omitted since it is similar to FIG. 1. FIG. 9 corresponds to FIG. 3 in the first embodiment. Note that in FIG. 9, elements similar to those shown in FIGS. 1 through 3 are denoted by the same reference numerals. Hereinbelow, the loudspeaker according to the fourth embodiment is described mainly with respect to differences from the loudspeaker according to the first embodiment.

In FIG. 9, a polymer film 401 is fixed on a surface of the voice coil 105 that is opposite to a bonding surface bonded to the diaphragm 101. The polymer film 401 is fixed on the voice coil 105 and a planar portion of the diaphragm 101 so as to cover the voice coil 105. As shown in FIG. 9, in the fourth embodiment, the voice coil 105 is sandwiched by the polymer film 401 and the groove 103, thereby increasing the adhesive strength of the voice coil 105 and the diaphragm 101.

Figure 10:
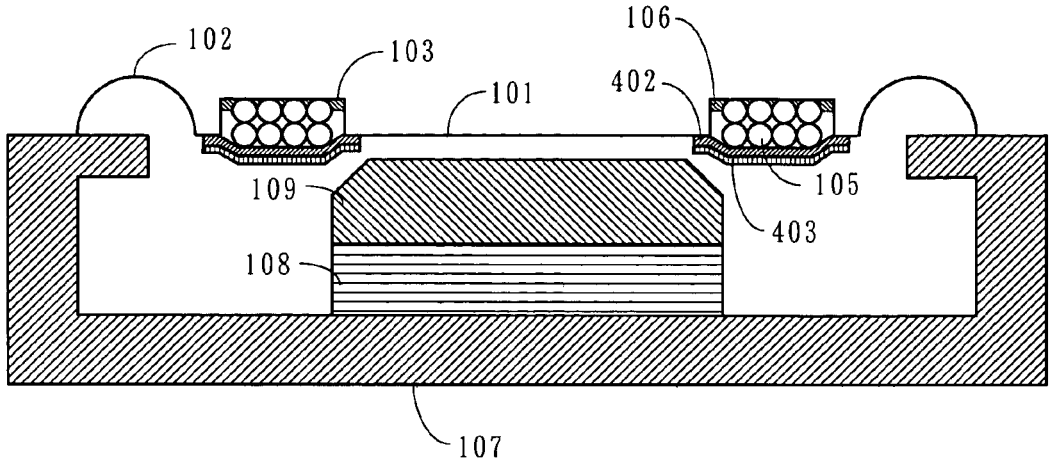
FIG. 10 is a cross-sectional view of a variation of the loudspeaker according to the fourth embodiment in the short axis direction.

Note that in the fourth embodiment, a film 402 having metal foil 403 evaporated thereon may be used instead of using the polymer film 401 (see FIG. 10). Note that as the metal foil 403, aluminum or copper foil with satisfactory thermal conductivity is preferably used. By using the film 402 and the metal foil 403, it is possible to achieve an effect similar to that achieved by providing the polymer film 401, and to increase thermal conductivity, thereby achieving an effect of preventing the temperature of the voice coil 105 from being increased, and increasing resistance to input overload. Alternatively, instead of using the polymer film 401, only metal foil may be used.

Fifth Embodiment

Figure 11:
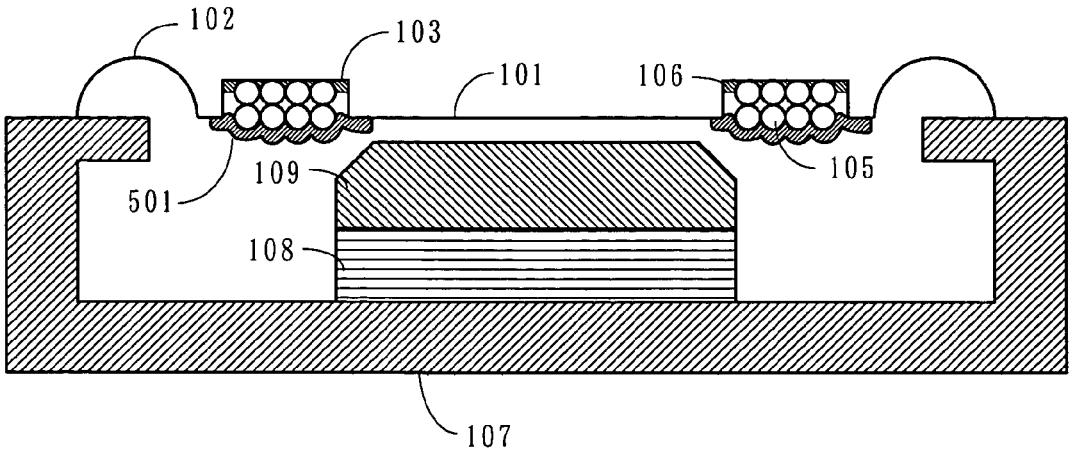
FIG. 11 is a cross-sectional view of a loudspeaker according to a fifth embodiment in the short axis direction.

Described next is a loudspeaker according to a fifth embodiment. FIG. 11 is a cross-sectional view of the loudspeaker according to the fifth embodiment in the short axis direction. Note that the loudspeaker according to the fifth embodiment has an external appearance similar to that of the loudspeaker according to the first embodiment. A plan view of the loudspeaker is omitted since it is similar to FIG. 1. FIG. 11 corresponds to FIG. 3 in the first embodiment. Note that in FIG. 11, elements similar to those shown in FIGS. 1 through 3 are denoted by the same reference numerals. Hereinbelow, the loudspeaker according to the fifth embodiment is described mainly with respect to differences from the loudspeaker according to the first embodiment.

In the fifth embodiment, instead of the polymer film 401, a viscoelastic rubber sheet 501 is fixed on the voice coil 105 and the planar portion of the diaphragm 101. Specifically, in the fifth embodiment, the voice coil 105 is sandwiched by the rubber sheet 501 and the groove 103, thereby increasing the adhesive strength between the voice coil 105 and the diaphragm 101 as in the fourth embodiment. Moreover, in the fifth embodiment, the viscoelastic rubber sheet 501 is used so that internal loss of the rubber sheet 501 prevents unnecessary resonance of the voice coil 105. Therefore, it is possible to further reduce the distortion of the diaphragm 101 during vibration.

Figure 12:
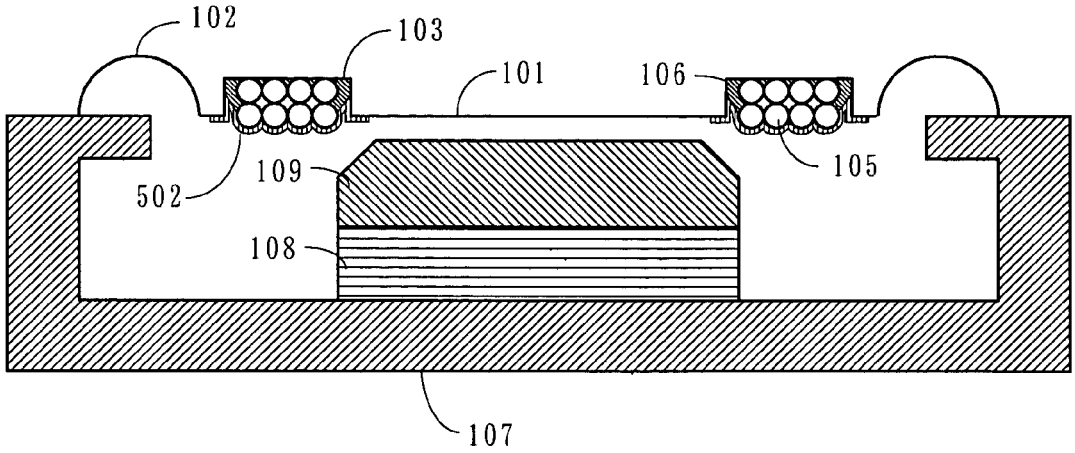
FIG. 12 is a cross-sectional view of a variation of the loudspeaker according to the fifth embodiment in the short axis direction.

Note that in the fifth embodiment, instead of using the rubber sheet 501, a viscoelastic polymer sheet, viscoelastic foam, or viscoelastic polymer foam may be used. An effect similar to that achieved by using the rubber sheet 501 can be achieved by using a viscoelastic material as mentioned here. Alternatively, instead of using the rubber sheet 501, a viscoelastic coating 502 may be formed on a surface of the voice coil 105 (see FIG. 12). Specifically, a liquid viscoelastic body is applied and dried on the voice coil 105 to thinly form the viscoelastic coating 502 on the surface of the voice coil 105. Note that as a material for the viscoelastic coating, a polymer material with high internal loss (e.g., a material obtained by dissolving a rubber material, such as nitrile butadiene rubber (NBR) or styrene butadiene rubber (SBR), in a solvent) or an adhesive or metamorphous silicon of a water soluble emulsion type is preferably used. By using the viscoelastic coating 502, it is possible to achieve an effect similar to that achieved by using the rubber sheet 501. Note that in FIG. 12, although adhesive is provided as an adhesive fillet on the side surfaces of the voice coil 105, the adhesive does not have to be provided in the form of the adhesive fillet.

Sixth Embodiment

Figure 13:
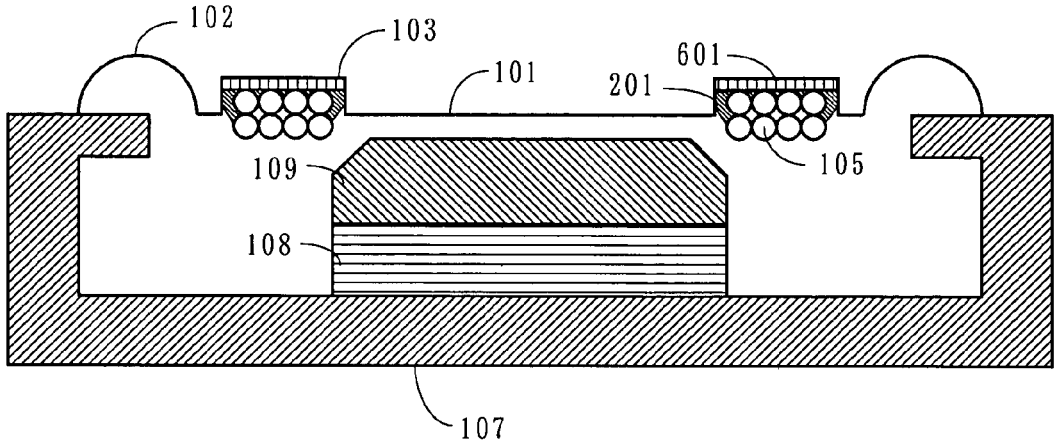
FIG. 13 is a cross-sectional view of a loudspeaker according to a sixth embodiment in the short axis direction.

Described next is a loudspeaker according to a sixth embodiment. FIG. 13 is a cross-sectional view of the loudspeaker according to the sixth embodiment in the short axis direction. Note that the loudspeaker according to the sixth embodiment has an external appearance similar to that of the loudspeaker according to the first embodiment. A plan view of the loudspeaker is omitted since it is similar to FIG. 1. FIG. 13 corresponds to FIG. 3 in the first embodiment. Note that in FIG. 13, elements similar to those shown in FIGS. 1 through 3 are denoted by the same reference numerals. Hereinbelow, the loudspeaker according to the sixth embodiment is described mainly with respect to differences from the loudspeaker according to the first embodiment.

In the sixth embodiment, the voice coil 105 is bonded to the bottom of the groove 103 via a cushioning material 601. That is, the cushioning material 601 is bonded to the groove 103, and the voice coil 105 is bonded to the cushioning material 601. The cushioning material 601 may be made of a heat-resisting sheet material such as paper or polyimide, or may be formed by a high viscoelastic sheet material such as rubber. In the sixth embodiment, the cushioning material 601 having a damping effect is placed between the voice coil 105 and the diaphragm 101, so that vibration of the voice coil 105 is transmitted through the cushioning material 601 to the diaphragm 101. Specifically, internal loss of the cushioning material 601 prevents unnecessary resonance of the voice coil 105, thereby increasing sound quality of the loudspeaker. Moreover, if the high heat-resisting material is used as the cushioning material 601, heat generated by the voice coil 105 becomes hard to be transmitted to the diaphragm 101, whereby it is possible to increase the durability of the loudspeaker.

Note that a structure as described in the fourth or fifth embodiment may be combined with the sixth embodiment. Specifically, in the sixth embodiment, a surface of the voice coil 105, which is opposite to a bonding surface bonded to the diaphragm 101, may be fixed to a film as described in the fourth or fifth embodiment.

Seventh Embodiment

Figure 14:
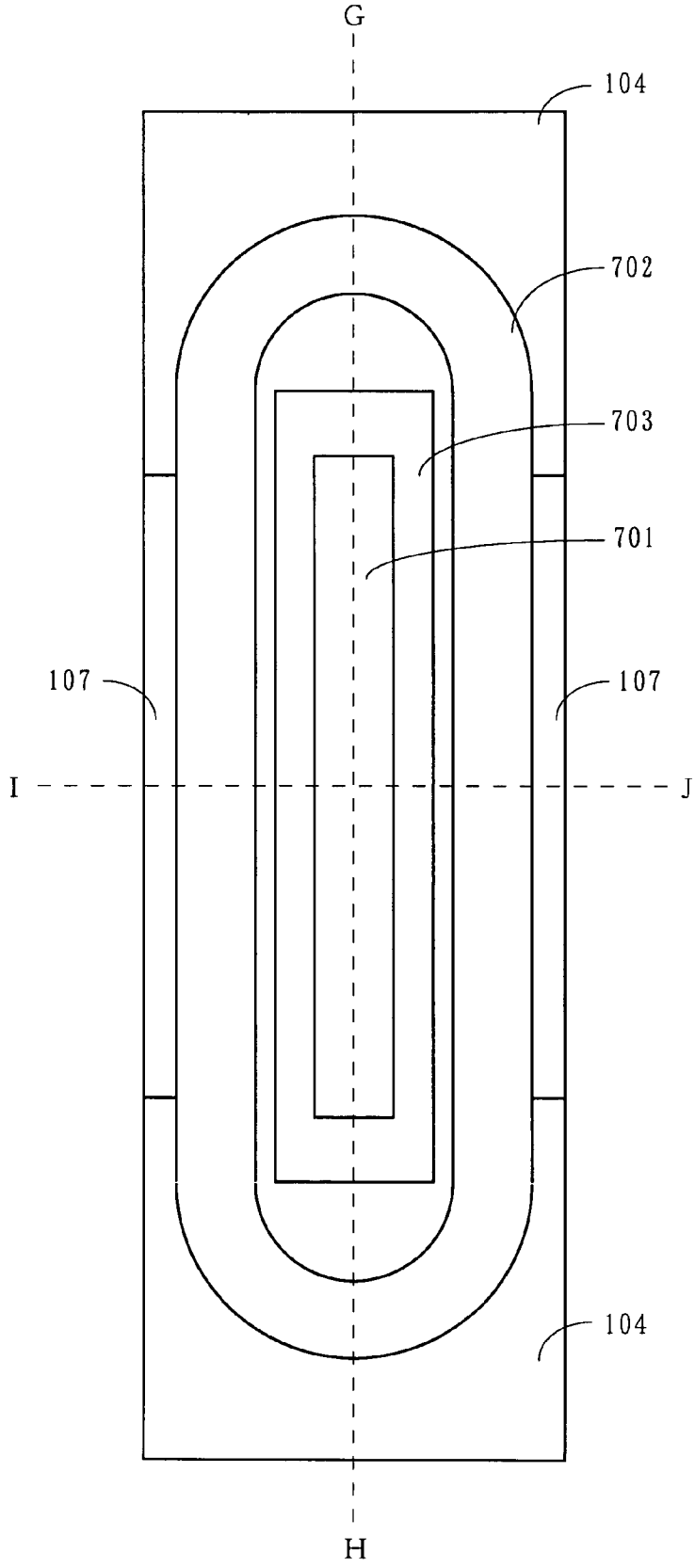
FIG. 14 is a plan view of a loudspeaker according to a seventh embodiment.
Figure 15:
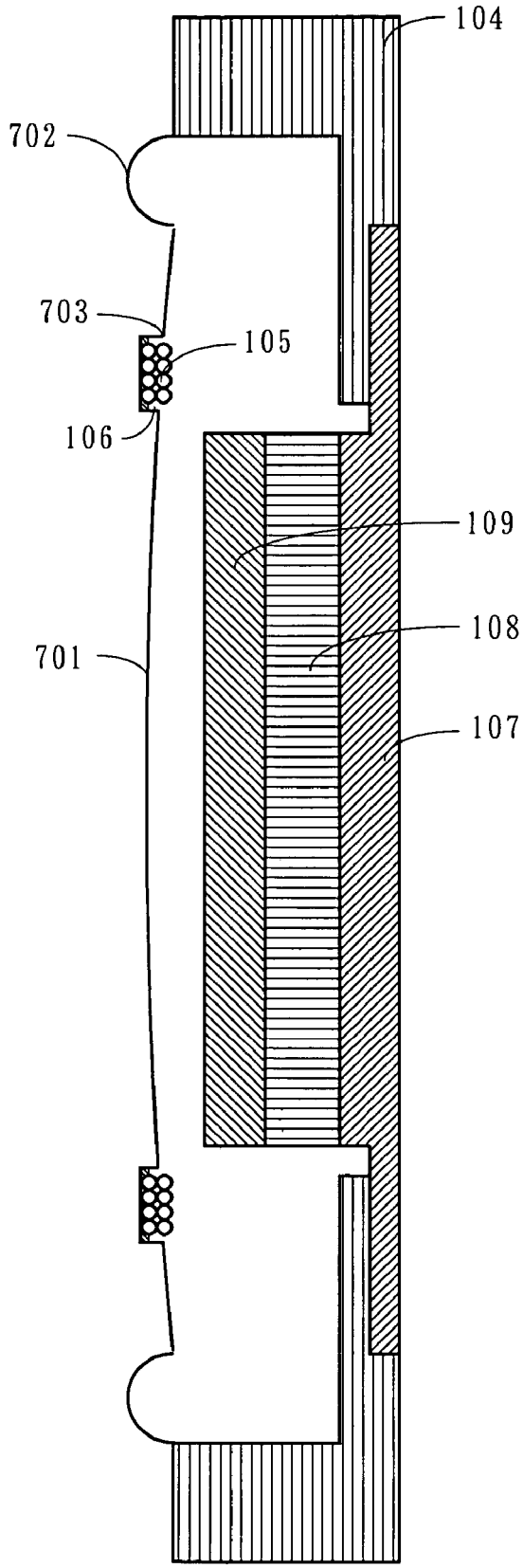
FIG. 15 is a cross-sectional view of the loudspeaker according to the seventh embodiment in the long axis direction.
Figure 16:
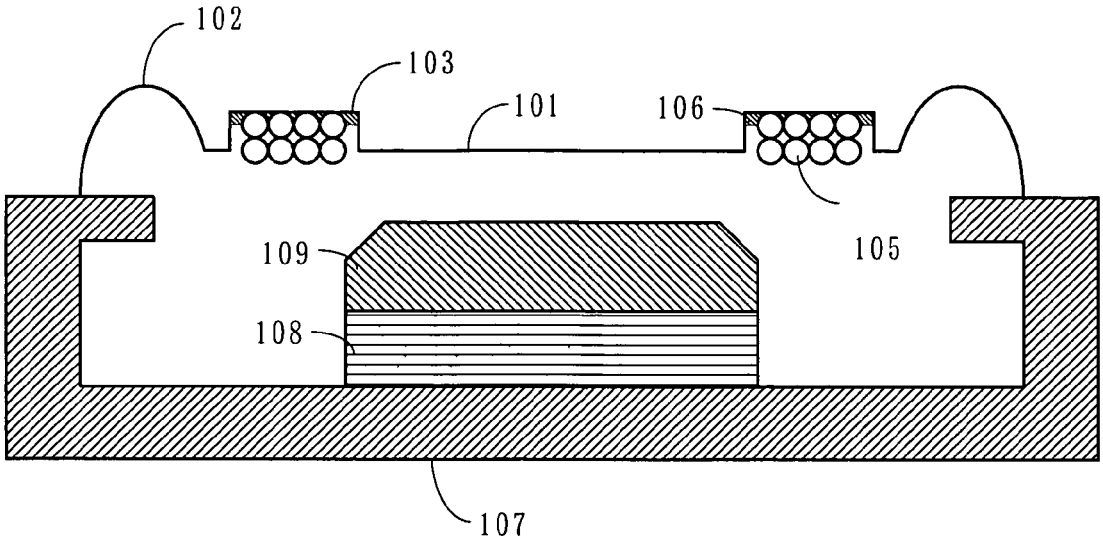
FIG. 16 is a cross-sectional view of the loudspeaker according to the seventh embodiment in the short axis direction.

Described next is a loudspeaker according to a seventh embodiment. FIG. 14 is a plan view of the loudspeaker, FIG. 15 is a cross-sectional view (a G-H cross-sectional view) of the loudspeaker in the long axis direction, and FIG. 16 is a cross-sectional view (an I-J cross-sectional view) of the loudspeaker in the short axis direction. Note that in FIGS. 14 through 16, elements similar to those in FIGS. 1 through 3 are denoted by the same reference numerals. Hereinbelow, the loudspeaker according to the seventh embodiment is described mainly with respect to differences from the loudspeaker according to the first embodiment.

In the seventh embodiment, instead of using the diaphragm 101 having a roughly planar shape, a diaphragm 701 having an arc-shaped cross section in the long axis direction is used. An edge 702 is provided so as to form a loop around an outer circumference of the diaphragm 701. Similar to the edge 102 as described in the first embodiment, the edge 702 has a roughly half-round shape cross section. The edge 702 is coupled at its outer circumference to the frame 104 and the yoke 107.

As shown in FIG. 15, the cross section of the diaphragm 701 is in the shape of an arch in which a center portion is higher than end portions. The arc shape of the diaphragm 701 is structured so as to be in the range less than or equal to the height of the edge 702. The seventh embodiment is similar to the first embodiment except that the cross section of the diaphragm 701 is arc-shaped. Specifically, the diaphragm 701 includes a groove 703 similar to the groove 103 as described in the first embodiment. The voice coil 105 is bonded to the bottom of the groove 703.

In the seventh embodiment, the diaphragm 701 is formed to have an arc-shaped cross section, thereby increasing the flexural rigidity of the diaphragm. This increases the high range resonance frequency, thereby enlarging a reproduction bandwidth of the loudspeaker. That is, it is possible to provide a loudspeaker capable of reproducing sound with higher quality. Further, the height of the arc shape of the diaphragm 701 is less than or equal to the height of the edge 702, and therefore the diaphragm 701 does not influence the entire thickness of the loudspeaker. That is, forming the loudspeaker into an arc shape does not increase the thickness of the loudspeaker.

Note that in the seventh embodiment, although the diaphragm 101 of the loudspeaker according to the first embodiment is replaced with the diaphragm 701 having the arch-shaped cross section, the diaphragm 101 of the loudspeaker according to any one of the second through sixth embodiments may be replaced with the diaphragm 701.

The present invention provides a loudspeaker which is capable of realizing reproduction sound with less distortion, and useful as a loudspeaker for use in a variety of types of audio apparatuses, particularly, in an audio visual apparatus.

Moreover, the loudspeaker of the present invention can be used for sound reproduction in a portable terminal apparatus, for example.

While the invention has been described in detail, the foregoing description is in all aspects illustrative and not restrictive. It is understood that numerous other modifications and variations can be devised without departing from the scope of the invention.

What is claimed is:

1. A loudspeaker comprising:

a horizontally or vertically elongated diaphragm including a groove having a concave cross section;

an edge having a roughly half-round shaped cross section and coupled to an outer circumference of the diaphragm; and a voice coil bonded to the groove, wherein the voice coil is thicker than a depth of the groove, wherein a thickness of the voice coil is smaller than a width of the groove, and wherein the voice coil has a cross section in which a dimension in a direction along a plane of the diaphragm is longer than a dimension in a direction perpendicular to the plane of the diaphragm.

2. A loudspeaker according to claim 1, wherein an adhesive for bonding the voice coil to the diaphragm is applied so as to form an adhesive fillet covering side surfaces of the voice coil.

3. A loudspeaker according to claim 1, wherein a plurality of protrusions, which each are smaller than a diameter of a wire of the voice coil, are provided on a bonding surface of the groove that is bonded to the voice coil.

4. A loudspeaker according to claim 1, wherein a cross section of the diaphragm along a longitudinal direction has a shape of an arc which is lower than the edge.

5. The loudspeaker according to claim 1, and further comprising:

a film fixed on the diaphragm and the voice coil so as to cover the voice coil on a side opposite to a bonding surface of the diaphragm that is bonded to the voice coil.

6. A loudspeaker according to claim 5, wherein the film is formed by any one of a polymer film, a polymer film having metal foil evaporated thereon, and the metal foil.

7. A loudspeaker according to claim 5, wherein the film is made of a viscoelastic material.

8. A loudspeaker according to claim 5, wherein a cross section of the diaphragm along a longitudinal direction has a shape of an arc which is lower than the edge.

9. The loudspeaker according to claim 1, further comprising:

a planar cushioning material bonded to the groove, wherein the voice coil is bonded to the groove via the cushioning material.

10. A loudspeaker according to claim 9, wherein a cross section of the diaphragm along a longitudinal direction has a shape of an arc which is lower than the edge.

* * * * *